US008127855B2

(12) United States Patent
Alvarado Vargas

(10) Patent No.: US 8,127,855 B2
(45) Date of Patent: Mar. 6, 2012

(54) ARTIFICIAL LIFT SYSTEM FOR STRIPPER AND MARGINAL WELLS

(75) Inventor: Maria Alejandra Alvarado Vargas, Torre B Maracay Edo. Aragua (VE)

(73) Assignee: Intevep, S.A., Caracas (VE)

( * ) Notice: Subject to any disclaimer, the term of this patent is extended or adjusted under 35 U.S.C. 154(b) by 424 days.

(21) Appl. No.: 12/345,874

(22) Filed: Dec. 30, 2008

(65) Prior Publication Data

US 2010/0163245 A1 Jul. 1, 2010

(51) Int. Cl.
*E21B 43/00* (2006.01)
*E21B 27/00* (2006.01)

(52) U.S. Cl. ..... 166/369; 166/68; 166/75.11; 166/108

(58) Field of Classification Search ..... 166/369, 166/68, 69, 84.1, 105, 105.1, 105.4, 108, 166/112, 75.11, 168; 417/36, 37, 904
See application file for complete search history.

(56) References Cited

U.S. PATENT DOCUMENTS

| | | | | | |
|---|---|---|---|---|---|
| 1,937,707 | A | * | 12/1933 | McDowell | 166/69 |
| 2,170,369 | A | * | 8/1939 | Hamilton | 166/63 |
| 4,086,035 | A | | 4/1978 | Klaeger, Jr. et al. | |
| 4,368,909 | A | | 1/1983 | Alexander, Jr. | |
| 4,404,093 | A | * | 9/1983 | Moyer | 210/138 |
| 4,516,911 | A | | 5/1985 | Senghaas et al. | |
| 4,583,916 | A | * | 4/1986 | Senghaas et al. | 417/36 |
| 2007/0199692 | A1 | | 8/2007 | Grant | |

* cited by examiner

*Primary Examiner* — Brad Harcourt
(74) *Attorney, Agent, or Firm* — Bachman & LaPointe, P.C.

(57) ABSTRACT

A fluid extraction system and method for the removal of fluid from subterranean wells. The system comprising: an upper extraction unit; an extraction container; a valve assembly engaged to the extraction container; a drainage tray engaged to the upper extraction unit; a curvilinear gear engaged to the upper extraction unit and the drainage tray; and, a linear gear engaged to the extraction container.

27 Claims, 9 Drawing Sheets

ARTIFICIAL LIFT SYSTEM FOR STRIPPER AND MARGINAL WELLS

BACKGROUND OF THE INVENTION

This invention relates to extracting fluid from subterranean wells, more particularly, this invention relates to a system for extracting oil from marginal or stripper wells.

As subterranean oil well ages, the marginal cost of retrieving oil from the well increases. When the cost of extracting the oil from the well is higher then desired, the well is defined as a "stripper well."

Stripper wells are normally straight and relatively shallow. These wells typically produce up to about 10 barrels of oil a day. Stripper wells may also produce various quantities of water with the oil. The oil produced from stripper wells is sometimes called "marginal oil." Since the cost of producing oil from a well with such a low production volume is marginally economical, the oil is labeled "marginal oil." As a result, when the current market value of oil is low, retrieval of marginal oil by current methods of extraction can be cost prohibitive.

Since stripper wells are wells of past high volume production, the exact locations of the wells and true marginal oil reserves remaining in the wells are known. Extracting marginal oil from stripper wells involves zero exploration costs and drilling costs; however, a cost effective system for the extraction of marginal oil from stripper wells is needed.

SUMMARY OF THE INVENTION

The primary object of the present invention is an economic system for the extraction of marginal oil from subterranean wells.

It is a further object of the present invention to provide a continuous system for the extraction of marginal oil from subterranean wells.

It is still a further object of the present invention to provide a continuous method for the extraction of marginal oil from subterranean wells.

In accordance with the present invention a fluid extraction system for the removal of fluid from a well is disclosed. The system comprises an upper extraction unit, an extraction container, a valve assembly, a drainage tray, a gear assembly and a collection tank.

In further accord with the present invention a method for the removal of fluid from a well is disclosed which comprises the steps of: employing an upper extraction unit; lowering an extraction container into the well; lifting the extraction container from the well; draining the fluid from the extraction container on to a drainage tray; diverting the fluid from the drainage tray in to a collection tank; and, repeating the step of lowering the extraction container into the well.

BRIEF DESCRIPTION OF THE DRAWINGS

A detailed description of preferred embodiments of the present invention follows, with reference to the attached drawings, wherein.

DETAILED DESCRIPTION

The invention relates to a cost effective system and method for the removal of fluid from subterranean wells.

Hereinafter the term "fluid" includes but is not limited to matter in gaseous and/or liquid state. The term "fluid" may refer to any one or all of the following terms: oil, water, liquids in an oil well, air and the like.

Hereinafter the term "well" includes but is not limited to any subterranean well. The term "well" may refer to any one or all of the following terms: stripper well, marginal well, oil well, reservoir and the like.

Figure 1:
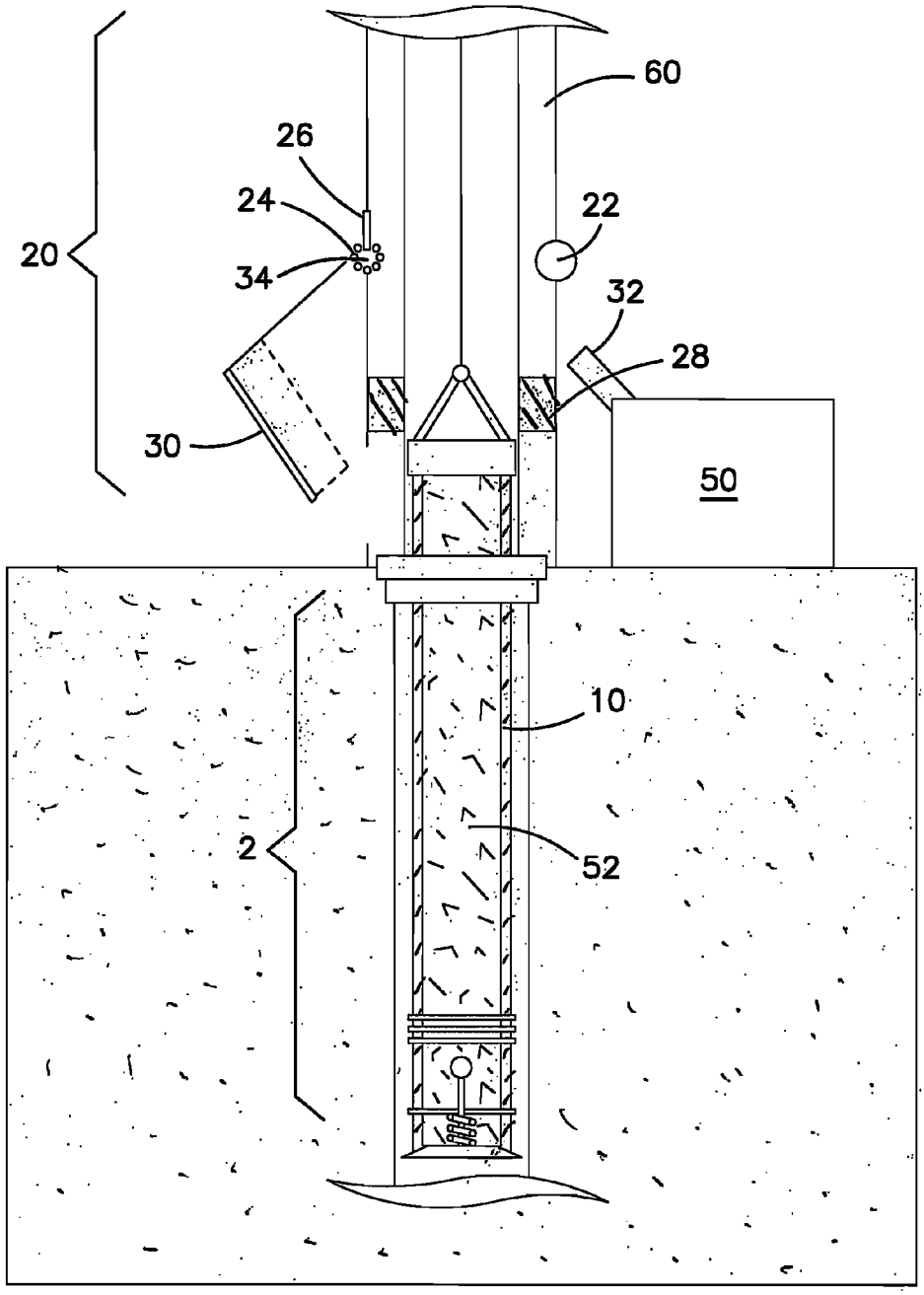
FIG. 1 illustratively depicts the extraction system in the down hole position.

Referring now to FIG. 1 there is shown, a well 2 with an extraction container 10. The extraction container 10 may be any container with a bottom, a top, an open configuration, a closed configuration, and an inner volume capable of holding a fluid. As shown, extraction container 10 is filled with the extraction fluid 52 and is in the process of being lifted from the well 2. The surface protector tube 60 protects and contains the extraction container 10 as it is lifted in and out of the well 2 by the upper extraction unit 20. The surface protector tube 60 may be any protective covering capable of protecting the components of the extraction system on the surface. The surface protector tube 60 may be a tube as described, or any housing or casing that is well known within the art. The upper extraction unit 20 may be any system, apparatus, mechanism or device that is well known within the art that is capable of lifting the extraction container in a vertical direction up and down the well hole.

When empty the extraction container 10 is lowered down hole by the upper extraction unit 20 to the level of the fluid to be extracted 52. The extraction container 10 is submerged in the fluid. The fluid to be extracted 52 enters and fills the extraction container 10 through the upper open end 14 of the extraction container 10. The open end 14 may be completely open, a hole(s), slit(s), or cut(s) at the upper end of the extraction container 10. Once filled, upper extraction unit 20 then begins to lift the extraction container 10 out of the well 2.

Figure 2:
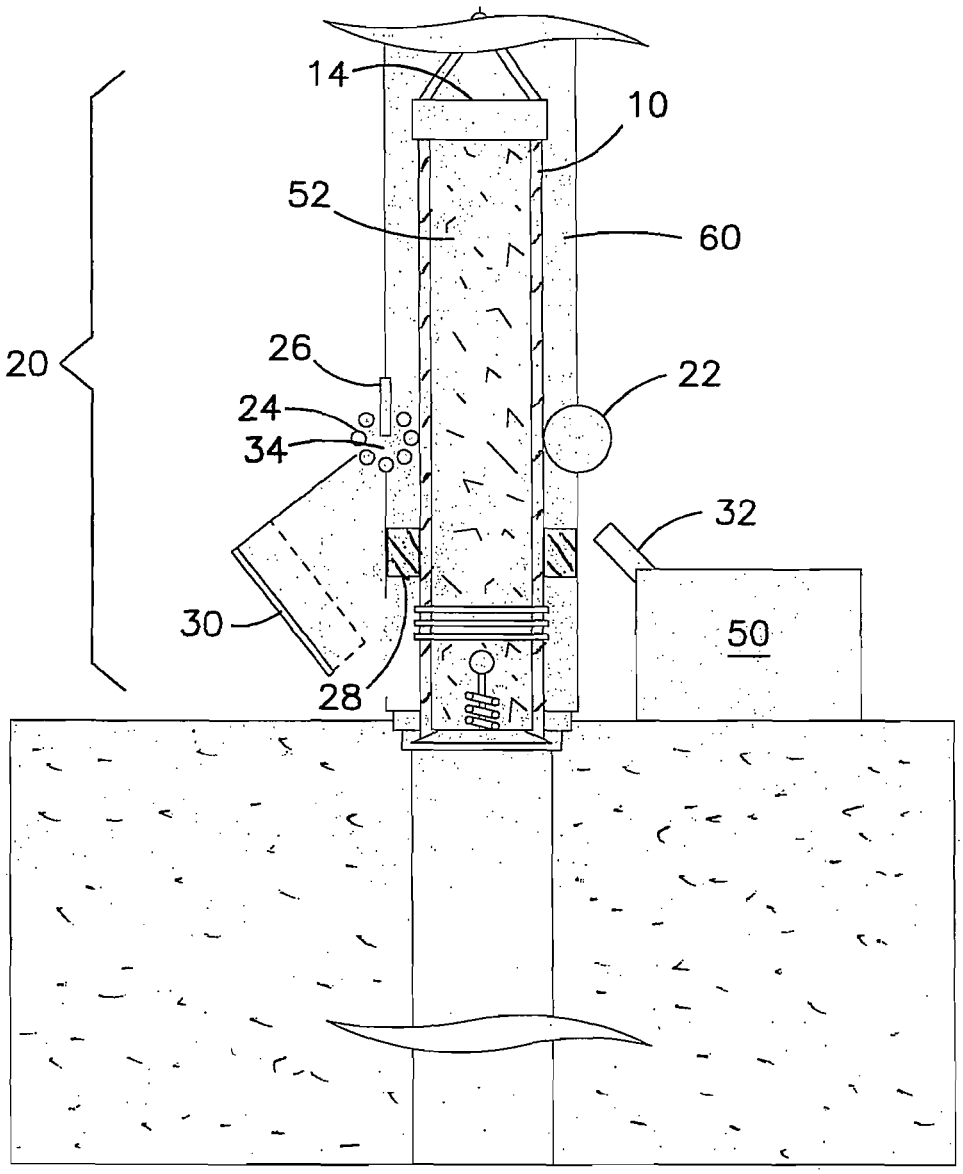
FIG. 2 illustratively depicts the filled extraction system as it is lifted to the surface.

Referring now to FIG. 2, the upper extraction unit 20 continues to lift the extraction container 10 filled with extraction fluid 52 out of the well 2.

Figure 3A:
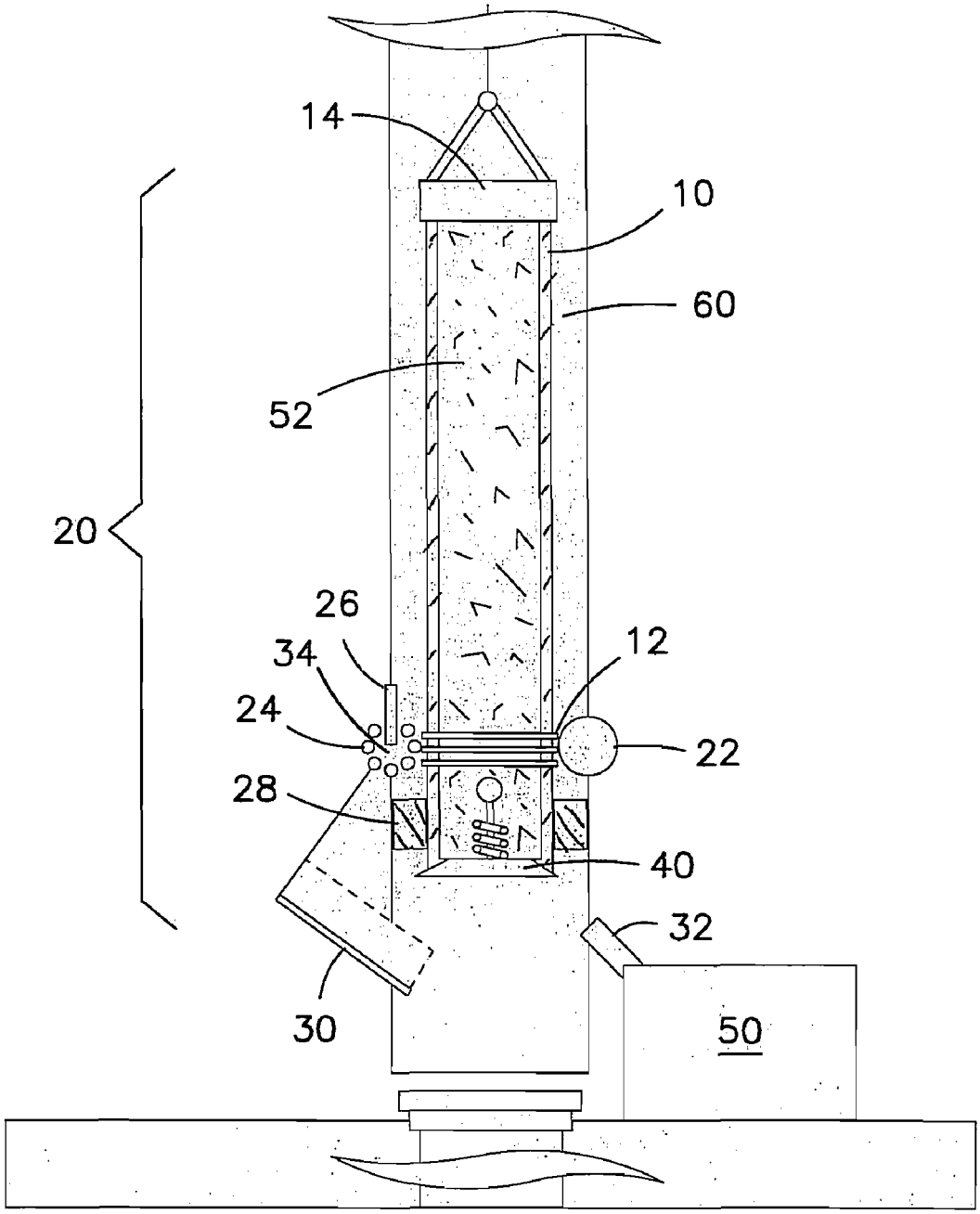
FIGS. 3*a* and 3*b* illustratively depict two embodiments of the filled extraction system as the linear gear on the extraction container contacts the curvilinear gear on the upper extraction unit.

Referring now to FIG. 3*a*, as the upper extraction unit 20 continues to lift the extraction container 10 filled with extraction fluid 52 out of the well 2, a linear gear 12 attached to the extraction container 10 contacts a curvilinear gear 24 attached to the upper extraction unit 20. As the upper extraction unit 20 continues to lift the extraction container 10, the support means 22 stabilizes the upper extraction unit 20 as the linear gear 12 of the extraction container 10 contacts and begins to rotate the curvilinear gear 24 which is attached to the upper extraction unit 20 and the gear axle 34 that is connected to a drainage tray 30. The rotation of the curvilinear gear 24 begins to move the gear axle 34 that is connected to a drainage tray 30. The movement of the gear assembly, i.e. the linear gear 12, the curvilinear gear 24, the axle stop 26, and the gear axle 34 that is connected to a drainage tray 30, translates the vertical movement of the extraction container 10 into curvilinear movement of the gear axle 34 that is connected to a drainage tray 30 so as to move the drainage tray 30 in to a position directly beneath the extraction container 10. The drainage tray 30 may be any container that is well known within the art that defines an inner volume and is capable of holding and transferring a fluid along a specified path.

Figure 3B:
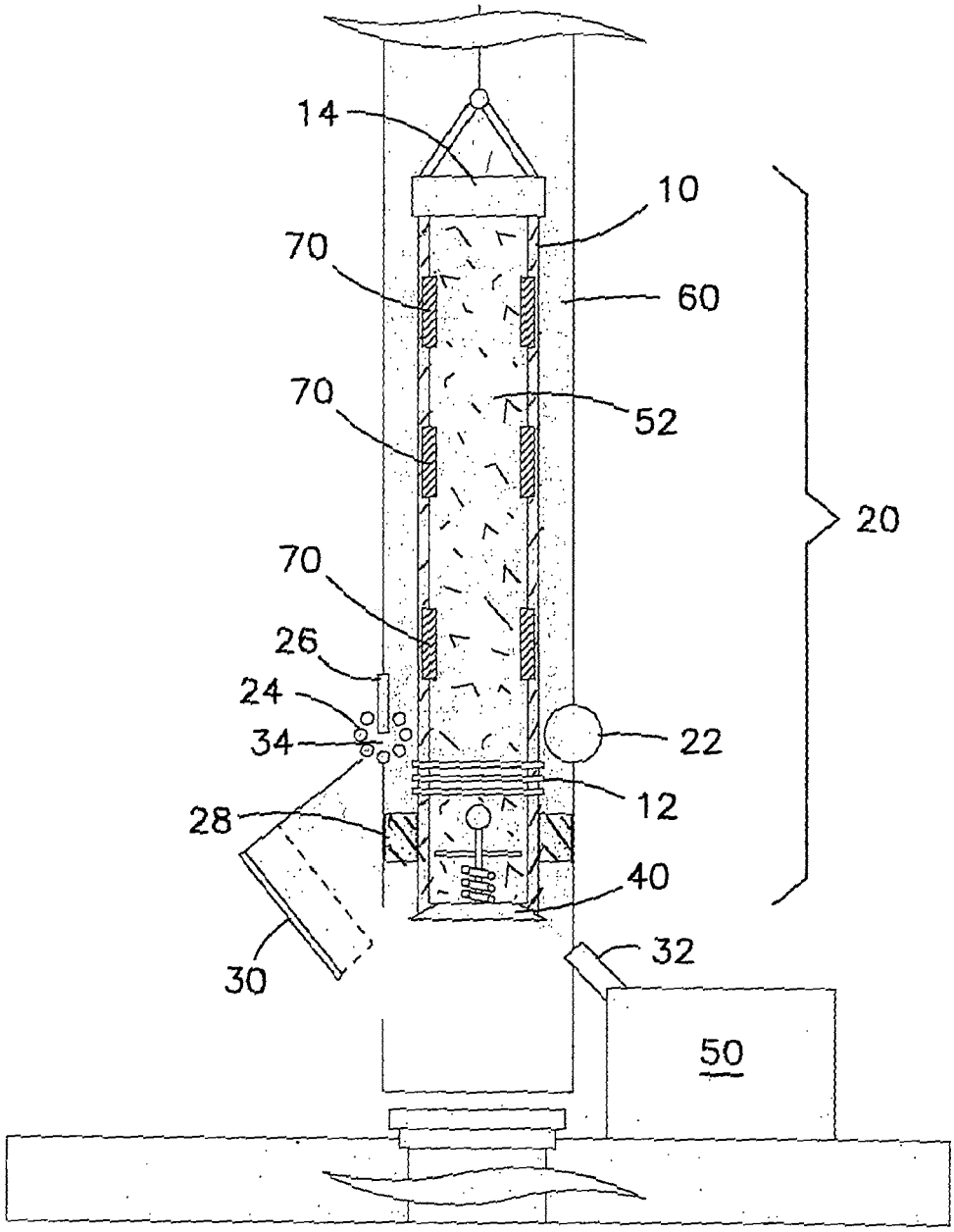

FIG. 3*b* details an additional embodiment of the extraction system. The extraction container 10 is modified to contain metal hose segments 70. The metal hose segments provide flexibility. Any flexible metal hose that is well known within the art may be used in the present disclosure. A few non limiting examples of metal hose include single braided metal hose, double braided metal hose, stripwound metal hose, corrugated metal hose and/or any combination of the differing varieties of flexible metal hose. By providing flexibility the rigidity of the extraction container 10 is reduced. By reducing the rigidity and increasing the flexibility of the extraction container 10, the extraction container 10 is able to travel smoothly up and down wells that contain deviations or minor obstructions.

Figure 4:
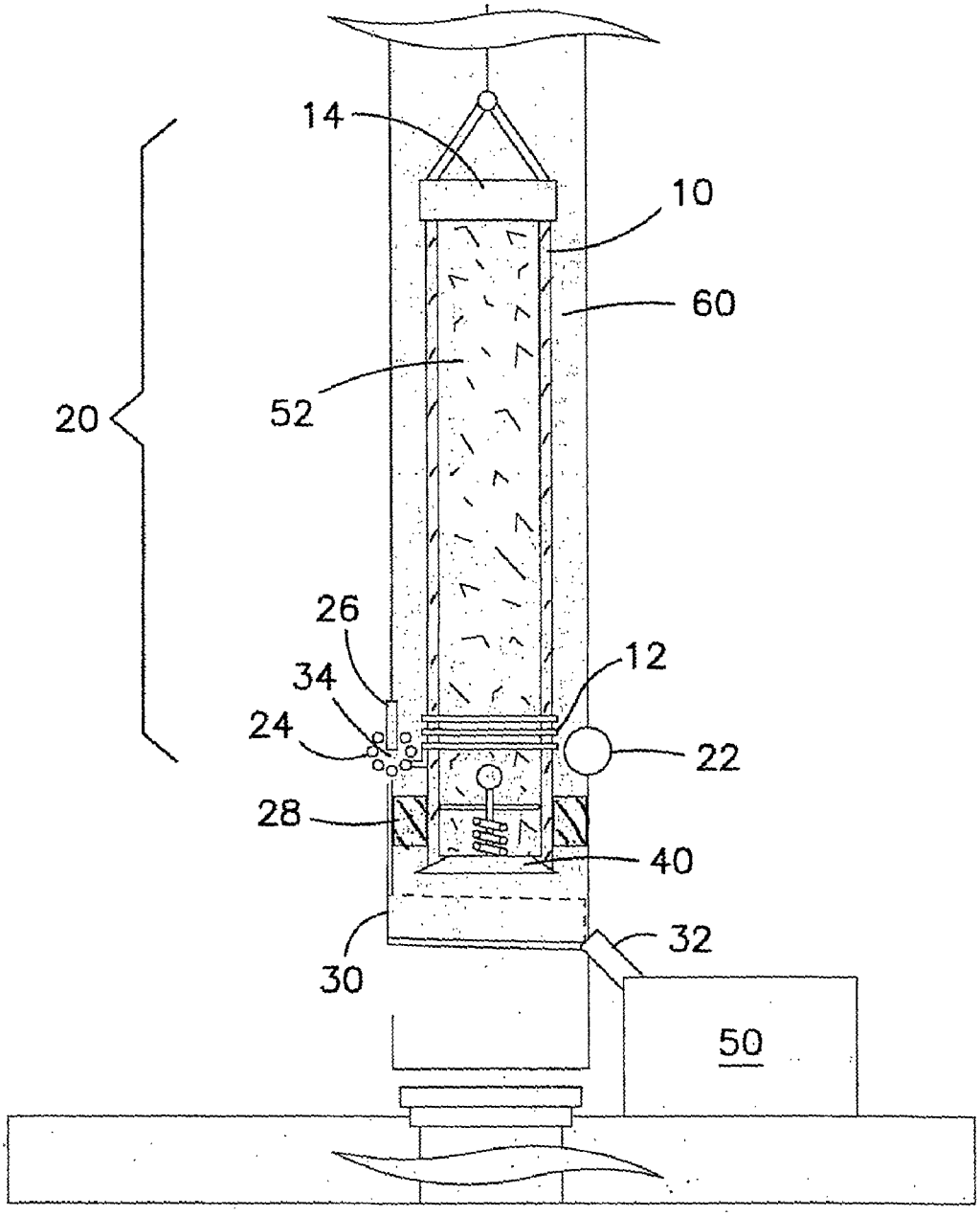
FIG. 4 illustratively depicts the extraction system with the drainage tray in a position beneath the filled extraction container.

Referring now to FIG. 4, as the extraction container 10 filled with extraction fluid 52 reaches its upper most position out of the well 2, linear gear 12 and the curvilinear gear 24 have interacted to move the drainage tray 30 to a position directly beneath the filled extraction container 52. The drainage tray 30 contacts the collection tank 50 through intermediate drainage means 32. Intermediate drainage means 32 may be any device or method used to transfer fluids from one container to another that is well known within the art.

Further referring to FIG. 4, when the upper extraction unit 20 lifts the extraction container 52 to its uppermost position out of the well 2, the valve assembly 40 comes into contact with the fixed travel stops 28 located on the upper extraction unit 20.

Figure 5:
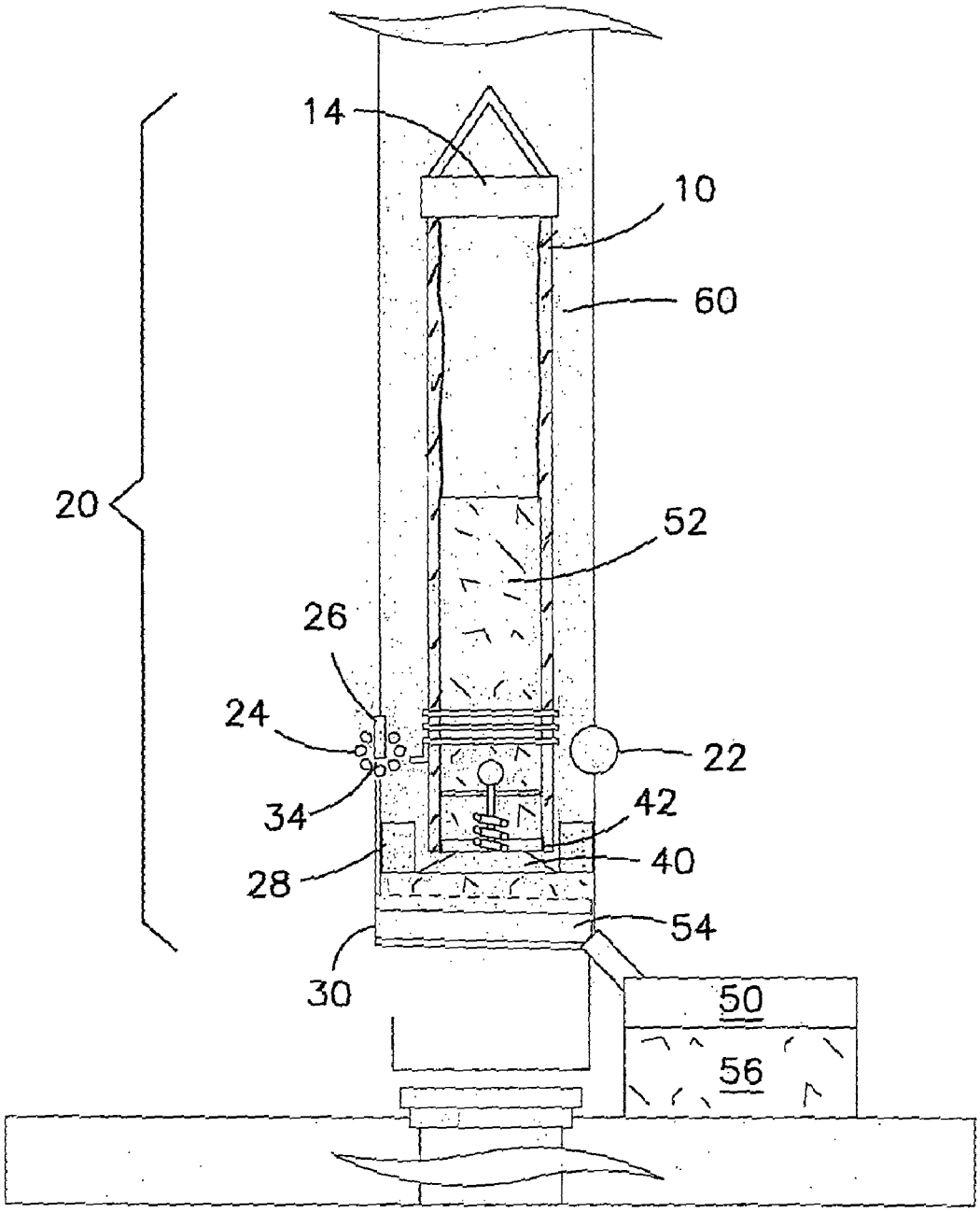
FIG. 5 illustratively depicts the draining of the extraction system as the extraction container opens when the valve assembly contacts the travel stop means.

Referring to FIG. 5, as the upper extraction unit 20 continues to lift the fluid extraction container 10 part of the valve assembly's 40 ascent is stopped and it is fixed in place by the fixed travel stop(s) 28. The travel stop(s) 28 may be any means or type of fixed prisoner or blockage that is well known with the art that is/are designed to halt the vertical movement. The unique design of the valve assembly 40, to be described in detail infra, allows the valve to remain connected to the ascending fluid extraction container 10 while opening when it is fixed in place by the fixed travel stops 28. This design allows the valve assembly 40 to have a closed configuration (For example FIGS. 3*a* and 3*b*) and an open configuration schematically shown at 42 in FIG. 4. Since the valve assembly 40 is connected to the fluid extraction container 10, the fluid extraction container 10 also has an open configuration and a closed configuration.

Continuing on FIG. 5, once the valve assembly 40 is in the open configuration 42, the fluid in the extraction container 52 begins to drain from the fluid extraction container 10 into the drainage tray 30. From the drainage tray 30 the extracted fluid 54 follows the fluid drainage path provided, such as intermediate drainage means 32, into a collection tank 50. The collection tank may be any fluid holding tank that is well known within the art. The final extracted fluid 56 may be piped to a storage facility, drained to a collection tank then piped to a storage facility or immediately processed for use.

Figure 6:
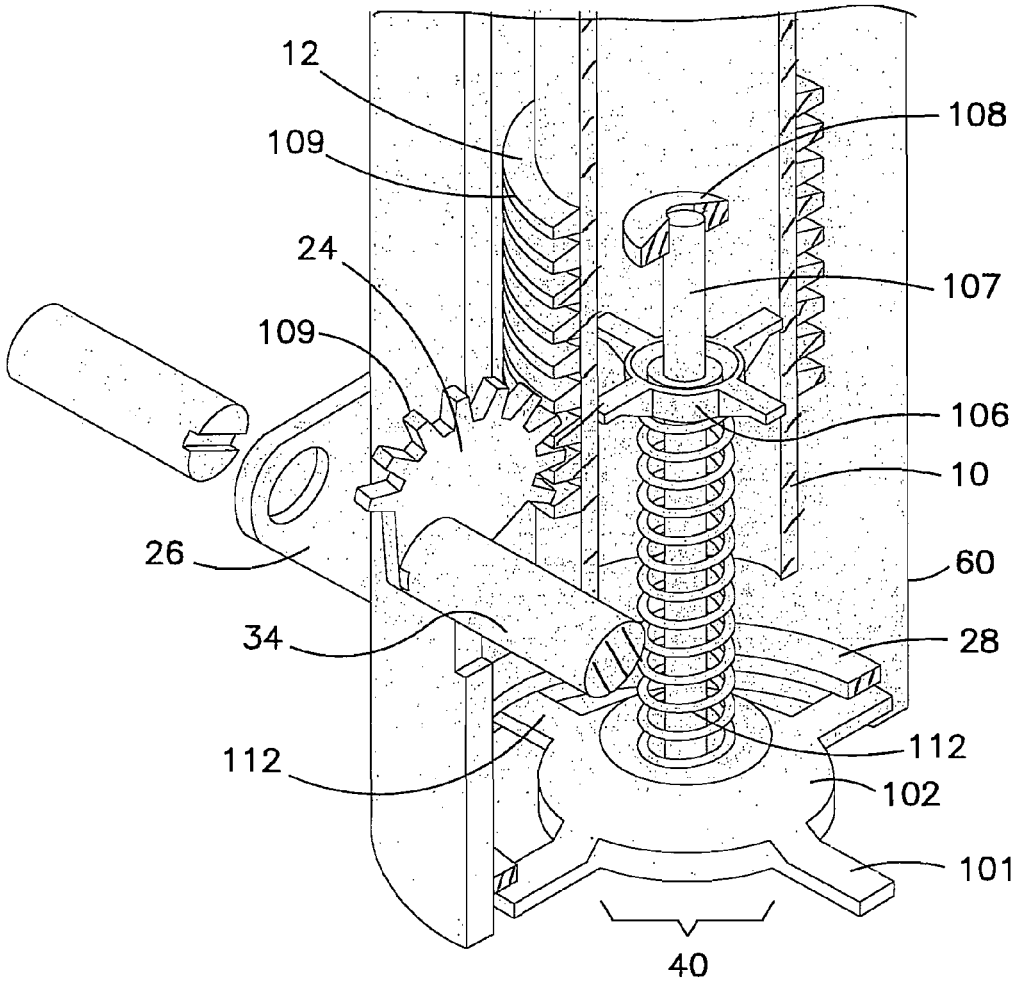
FIG. 6 illustratively depicts the valve assembly.

FIG. 6 is a magnified view of the valve assembly 40 and its parts. As the upper extraction unit 20 lifts the extraction container 10 in and out of the well 2, valve blade(s) 101 connected to the valve assembly 40 contact the travel stop(s) 28. As the extraction container 10 ascends out of the well 2, the valve blades 101 contact the travel stop(s) 28. The contact holds the valve blades 101 in place as the extraction container 10 continues its ascent. Upon this ascent the valve assembly 40 opens. The contact between the valve assembly 40 and the extraction container 10 is a beveled metal to metal seal 102. The valve blades 101 are connected to the extraction container 10 by a valve connecting rod 107. The rod 107 is designed to be in a compressed state when the valve assembly 40 is closed and to be in an expanded state when the valve assembly 40 is open. To conform to these changes the rod is equipped with a tension spring 112, a rod guide 106, and a rod stop 108.

Continuing on FIG. 6, as the extraction container 10 ascends out of the well 2, the valve blades 101 contact the travel stop(s) 28 and the linear gear 12 on the extraction container 10 contacts the curvilinear gear 24 on the upper extraction unit 20. When in contact, the gears form gear assembly 109. When the curvilinear gear 24 is rotated axle stop 26 supports the gear as the gear axle 34 that connects the drainage tray 30 to the curvilinear gear 24 moves the drainage tray 30.

As shown in FIGS. 1-6, when the extraction container 10 is lifted out of the well it is housed within the surface protector tube 60.

Figure 7A:
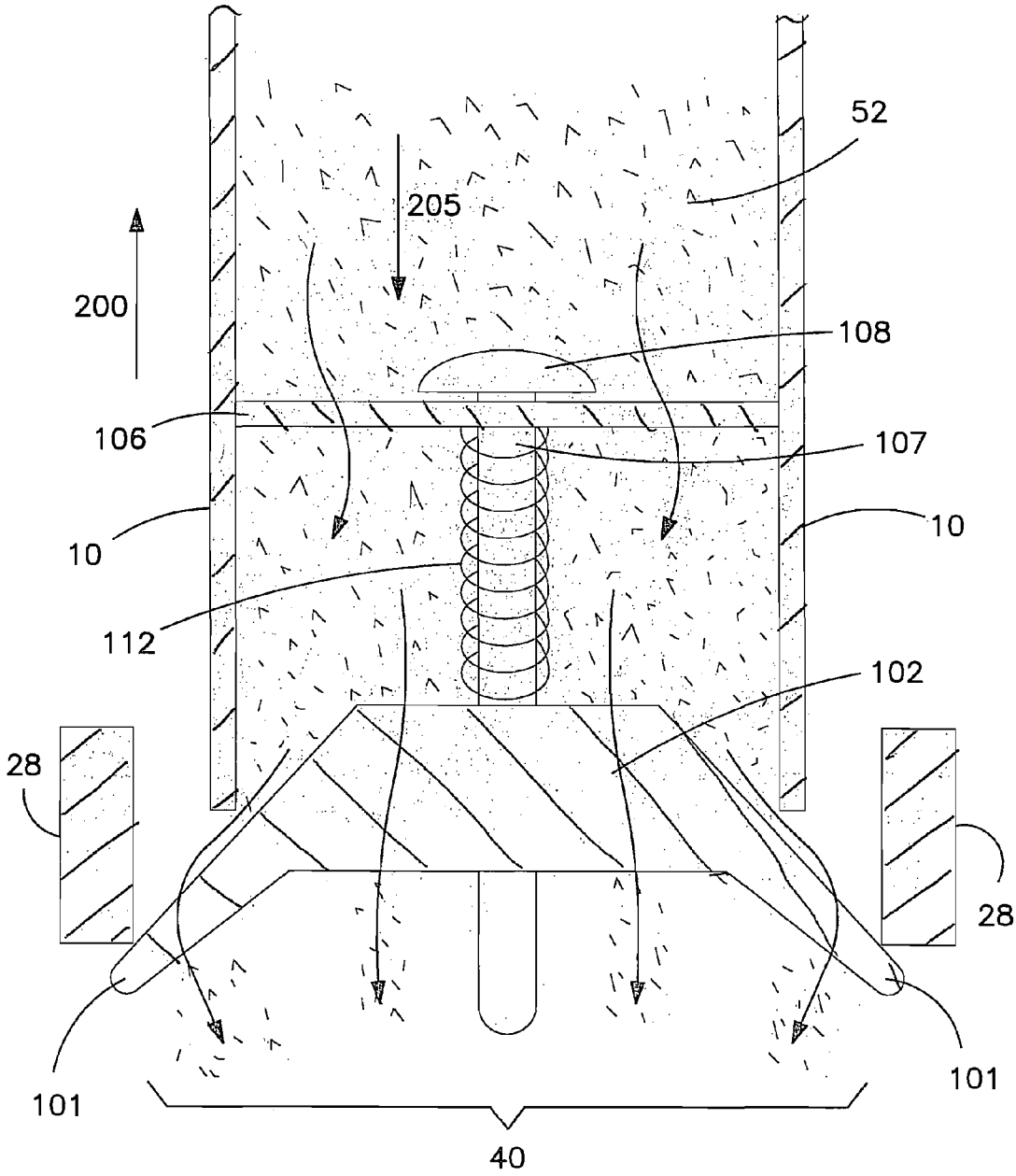
FIG. 7*a* illustratively depicts the valve assembly when open.

FIG. 7*a* depicts the valve assembly 40 and extraction container 10 in the open configuration. As the extraction container 10 travels out of the well in the direction of arrow 200 the travel stop means 28 contact the valve blades 101. The valve blades 101 are halted from moving in the direction of arrow 200 while the extraction container 10 continues in the direction of arrow 200. The beveled metal to metal seal 102 of the fluid retention valve assembly 40 on the extraction container 10 is broken as the valve blades 101 stop the valve assembly 40 from moving in the direction of arrow 200. As the extraction container 10 continues to move in the direction of arrow 200, the valve connecting rod 107 is pulled in the direction of arrow 205 through rod guide 106 until the rod guide 106 contacts the rod stop 108. Once the rod guide 106 contacts the rod stop 108 and the tension spring 112 of the valve connecting rod 107 is in the extended position, an open space is created between the valve assembly 40 and the extraction container 10. The fluid in the extraction chamber 52 begins to flow from the extraction container 10 in the direction of arrows 205.

Figure 7B:
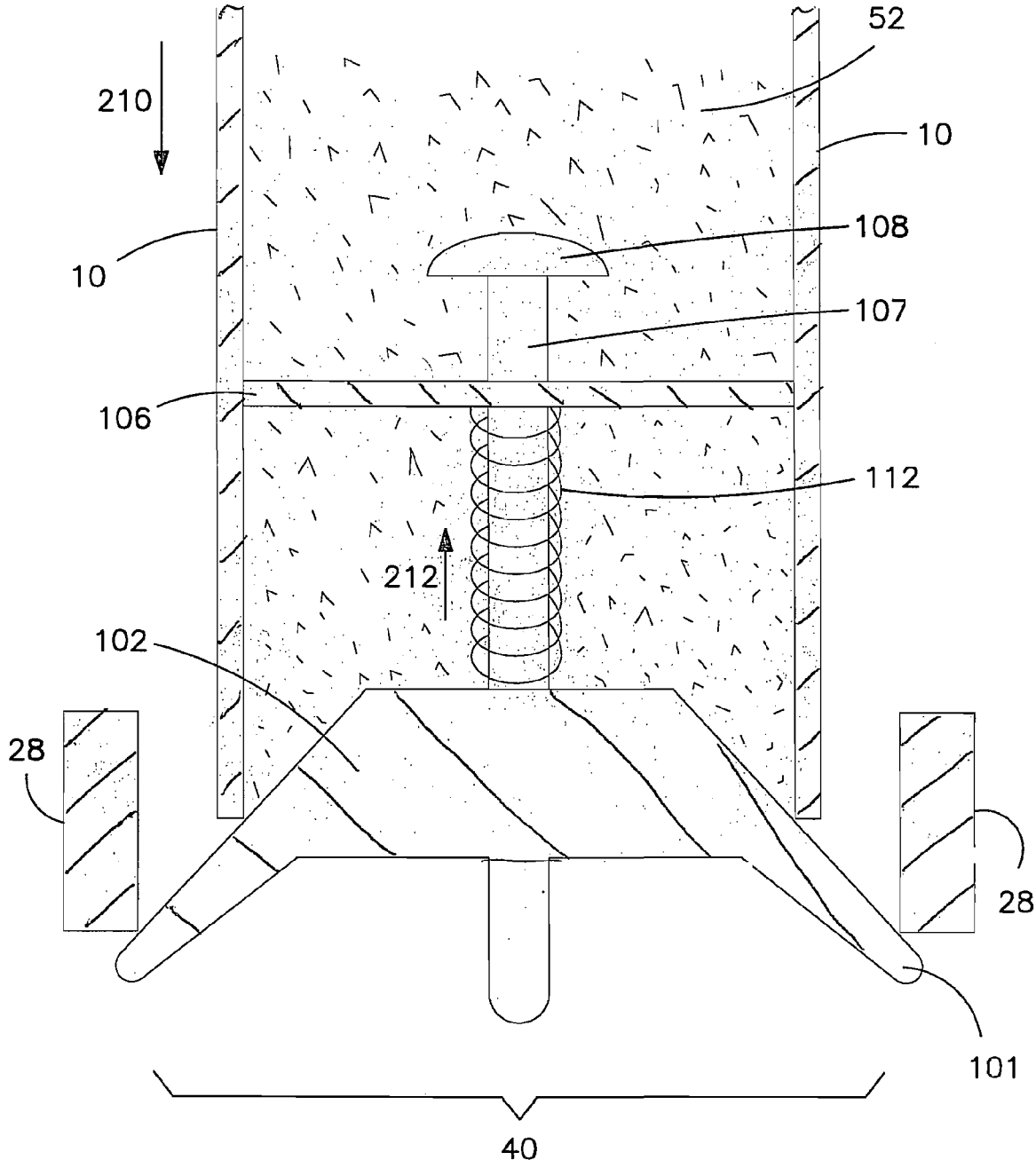
FIG. 7*b* illustratively depicts the valve assembly when closed.

FIG. 7*b* depicts the valve assembly 40 and extraction container 10 in the closed configuration. As the extraction container 10 travels into the well in the direction of arrow 210 the travel stop means 28 lose contact with the valve blades 101. As the travel stop means 28 lose contact with the valve blades 101, the tension spring 112 contracts in the direction of arrow 212, and the beveled metal to metal seal 102 of the fluid retention valve assembly 40 is pulled on to the extraction container 10. Once the tension spring 112 contracts in the direction of arrow 212 and the beveled metal to metal seal 102 of the fluid retention valve assembly 40 is pulled on to the extraction container 10, any open space is closed between the valve assembly 40 and the extraction container 10.

Example

An example of a typical extraction cycle is as follows.

The extraction container 10 comprising a linear gear 12, an opening 14, a valve assembly, i.e. a fluid retention valve 40, opening blades 101, a valve connecting rod 107, a rod tension spring 112, a rod guide 106, and a rod stop 108, is lowered into a well by upper extraction unit 20 comprising a surface protector tube 60, travel stops 28, a curvilinear gear 24, an axle stop 26, a gear axle 34 connected to a drainage tray 30, a stabilizing support 22, an intermediate drainage apparatus 32, and a collection tank 50.

The extraction container 10 is lowered into the well to a point beneath the top level of the fluid to be extracted. The fluid fills the extraction container 10 through opening 14. Once filled with fluid the extraction container 10 is lifted out of the well by upper extraction unit 20 into protector tube 60.

As the extraction container 10 ascends from the well, the linear gear 12 on the extraction container 10 contacts the curvilinear gear 24 on the upper extraction unit 20. Upon contact curvilinear gear 24 translates the vertical movement of the extraction container 10 into curvilinear movement of the gear axle 34 that is connected to a drainage tray 30. As the extraction container 10 ascends, i.e. upward stroke of the upper extraction unit 20, in the surface protector tube 60, the gear assembly 109 moves the gear axle 34 that is connected to the drainage tray 30 until the drainage tray 30 is in a position beneath the valve assembly 40 of the extraction container 10. Once in position, axle stop 26 stabilizes the gear axle 34 and the drainage tray 30.

As the extraction container 10 continues to ascend in the surface protector tube 60, travel stop(s) 28 connected to the surface protector tube 60 contact the valve blades 101 on the valve assembly 40. When the valve blades 101 are contacted by the travel stop(s) 28 the valve connecting rod 107 connected to the valve blades 101 begins to expand. The expansion of the valve connecting rod 107 allows the metal to metal contact of the valve assembly 40 with the extraction container 10 to open. The expansion of the valve connecting rod 107 is controlled by a rod guide 106 and a rod stop 108.

When the metal to metal contact of the valve assembly 40 with the extraction container 10 opens, the extracted fluid within the extraction container 10 begins to drain from the extraction container 10 on to the curvilinear movement positioned drainage tray 30. The extracted fluid drains from the drainage tray 30 through an intermediate drainage apparatus 32 into a collection tank 50.

Once the extraction container 10 is drained, the upper extraction unit lowers the extraction container 10 out of the surface protector tube 60 and back down into the well. As the extraction container 10 starts its descent out of the surface protector tube 60, the metal to metal contact of the valve assembly 40 with the extraction container 10 is closed. The valve blades 101 on the valve assembly 40 loose contact with the travel stop(s) 28 and the rod tension spring 112 tightens. As the valve connecting rod 107 is guided by the rod guide 116, the tension spring 112 contracts the valve assembly 40 effectively sealing and closing the beveled metal to metal contact of the valve assembly 40 with the extraction container 10.

As the extraction container 10 continues its descent out of the surface protector tube 60, axle stop 26 is dislodged when the gear assembly 109 reverses direction. This downward stroke of the extraction container 10 into the well provides for a reversal in contact between the linear gear 12 and the curvilinear gear 24. The curvilinear gear 24 is rotated in a reverse direction, thus the gear axle 34 that is connected to the drainage tray 30 is rotated in a curvilinear direction away from the extraction container 10. As the gear assembly 109 looses contact, the gear axle 34 that is connected to a drainage tray 30 is in a position away from the well hole. Once again the extraction container 10 is lowered into the well by the upper extraction unit 20 to a point beneath the top level of the fluid to be extracted.

The extraction system described above may be a continuous process for the extraction of fluid from subterranean wells.

The extraction system of the present invention may be implemented in other possible applications. The final characteristics of the extraction system of the present invention may be applied to conventional well technology, and any application that may benefit from the extraction system of the present invention.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A fluid extraction system for the removal of fluid from a well, the system comprising:

an upper extraction unit;

an extraction container movable relative to the upper extraction unit between a lowered position where the extraction container is in the well and fluid enters the extraction container, and an upper position where fluid drains from the extraction container wherein the extraction container comprises a top, a bottom, an open configuration, a closed configuration and a linear gear;

a valve assembly in the extraction container; and a drainage tray movably engaged to the upper extraction unit;

wherein movement of the extraction container from the lowered position to the upper position moves the drainage tray to a position to contact the fluid as it drains from the extraction container.

2. The fluid extraction system of claim 1, wherein the system is continuous.

3. The fluid extraction system of claim 1, wherein the fluid is oil.

4. The fluid extraction system of claim 1, wherein the extraction container contains flexible metal hose segments.

5. The fluid extraction system of claim 1, wherein the upper extraction unit further comprises a lifting mechanism connected to the extraction container, a curvilinear gear movably connected to the drainage tray, support means and travel stop means.)

6. The fluid extraction system of claim 5, wherein the lifting mechanism is capable of lowering the extraction container into and lifting the extraction container out of the well.

7. The fluid extraction system of claim 6, wherein the travel stop means is positioned to contact the valve assembly when the extraction container is lifted out of the well.

8. The fluid extraction system of claim 7, wherein the extraction container defines an inner volume capable of storing fluid.

9. The fluid extraction system of claim 8, wherein the extraction container is in the open configuration when the valve assembly is contacted by the travel stop means as the extraction container is lifted out of the well and wherein the extraction container is in the closed configuration when the travel stop means is not in contact with the valve assembly as the extraction container is lowered into the well.

10. The fluid extraction system of claim 9, wherein as the extraction container is lifted out of the well the drainage tray is moved to a position under the bottom of the extraction container when the curvilinear gear is contacted by the linear gear.

11. The fluid extraction system of claim 10, wherein when the extraction container is in the open configuration the drainage tray is in the position under the bottom of the extraction container and diverts fluid expelled from the open configuration extraction container into a collection tank.

12. The fluid extraction system of claim 1, wherein the valve assembly comprises a fluid retention valve, at least one valve blade, a valve connecting rod, a rod tension spring, a rod guide, and a rod stop.

13. A method for the removal of fluid from a well comprising:

employing an upper extraction unit comprising a lifting mechanism to lift and lower an extraction container into the well, wherein the extraction container comprises a top, a bottom, an open configuration, a closed configuration, a valve assembly and a linear gear;

lowering the extraction container into the well;

lifting the extraction container from the well;

draining the fluid from the extraction container onto a drainage tray;

diverting the fluid from the drainage tray into a collection tank; and repeating the step of lowering the extraction container into the well.

14. The method for the removal of fluid from a well of claim 13, wherein the lifting step moves the drainage tray to a draining position beneath the extraction container and opens the extraction container, and wherein the lowering step closes the extraction container and moves the drainage tray out from beneath the extraction container.

15. The method for the removal of fluid from a well of claim 13, wherein the method is continuous.

16. The method for the removal of fluid from a well of claim 13, wherein the fluid is oil.

17. The method for the removal of fluid from a well of claim 13, wherein the upper extraction unit further comprises a curvilinear gear, support means and travel stop means.

18. The method for the removal of fluid from a well of claim 17, wherein the extraction container comprises flexible metal hose segments.

19. The method for the removal of fluid from a well of claim 18, wherein the step of lifting the extraction container from the well comprises contacting the linear gear of the extraction container with the curvilinear gear movably located on the upper extraction unit and contacting the valve assembly located on the extraction container with a travel stop means located on the upper extraction unit.

20. The method for the removal of fluid from a well of claim 19, wherein the step of lowering engages the curvilinear gear attached to the drainage tray movably rotating the drainage tray into a position away from the extraction container.

21. The method for the removal of fluid from a well of claim 19, wherein the extraction container is in the open configuration.

22. The method for the removal of fluid from a well of claim 18, wherein the step of lowering the extraction container into the well comprises contacting the linear gear of the extraction container with the curvilinear gear movably located on the upper extraction unit and the loss of contact of the valve assembly located on the bottom of the extraction container with the travel stop means located on the upper extraction unit.

23. The method for the removal of fluid from a well of claim 22, wherein the step of lifting engages the curvilinear gear attached to the drainage tray movably rotating the drainage tray into a position under the extraction container.

24. The method for the removal of fluid from a well of claim 22, wherein the extraction container is in the closed configuration.

25. The method for the removal of fluid from a well of claim 18, wherein the valve assembly comprises a fluid retention valve, at least one valve blade, a valve connecting rod, a rod tension spring, a rod guide, and a rod stop.

26. A continuous method for the removal of fluid from a well comprising:

lowering an extraction container having a top; a bottom; an open configuration; a closed configuration; flexible metal hose; a valve assembly comprising a fluid retention valve, at least one valve blade, a valve connecting rod, a rod tension spring, a rod guide, and a rod stop; and a linear gear into the well;

employing an upper extraction unit to lift and lower the extraction container from the well, lifting the closed configuration extraction container from the well while simultaneously contacting the linear gear of the extraction container with a curvilinear gear movably located on the upper extraction unit, wherein the curvilinear gear is engaged to a drainage tray that is movably rotated into a position under the extraction container;

continuing to lift the extraction container from the well while simultaneously contacting the valve assembly located on the extraction container with a travel stop means located on the upper extraction unit; wherein the extraction container is in the open configuration;

draining the fluid from the open configuration extraction container onto the drainage tray;

diverting the fluid from the drainage tray into a collection tank; and lowering the extraction container into the well, wherein the linear gear contacts the curvilinear gear movably rotating the drainage tray away from the extraction container and wherein the extraction container is in the closed configuration as the valve assembly loses contact with the travel stop means.

27. A continuous fluid extraction system for the removal of fluid from a well, the system comprising:

an extraction container comprising a top, a bottom, flexible metal hose, an open configuration and a closed configuration, wherein the extraction container defines an inner volume capable of storing fluid;

an upper extraction unit comprising a lifting mechanism movably connected to the extraction container, support means and travel stop means, wherein the lifting mechanism is capable of lowering the extraction container into and lifting the extraction container out of the well;

a valve assembly comprising a fluid retention valve, at least one valve blade, a valve connecting rod, a rod tension spring, a rod guide, and a rod stop, engaged to the extraction container, wherein the extraction container is in the open configuration when the valve assembly is contacted by the travel stop means as the extraction container is lifted out of the well and wherein the extraction container is in the closed configuration when the travel stop means is not in contact with the valve assembly as the extraction container is lowered into the well;

a drainage tray movably engaged to the upper extraction unit;

a curvilinear gear engaged to the upper extraction unit and the drainage tray; and a linear gear engaged to the extraction container, wherein as the extraction container is lifted out of the well the drainage tray is moved to a position under the extraction container when the curvilinear gear is contacted by the linear gear and when the extraction container is in the open configuration the drainage tray is in the position under the extraction container ready to divert fluid expelled from the open configuration extraction container into a collection tank.

* * * * *